US010204608B1

(12) United States Patent
Erickson et al.

(10) Patent No.: US 10,204,608 B1
(45) Date of Patent: Feb. 12, 2019

(54) MOUTHPIECE RIM FOR NON-FRENCH HORN LABROSONE MUSICAL BRASS INSTRUMENTS

(71) Applicants: Sumner Perry Erickson, Austin, TX (US); Jessica Kristin Rogers, Austin, TX (US)

(72) Inventors: Sumner Perry Erickson, Austin, TX (US); Jessica Kristin Rogers, Austin, TX (US)

( * ) Notice: Subject to any disclaimer, the term of this patent is extended or adjusted under 35 U.S.C. 154(b) by 0 days.

(21) Appl. No.: 15/917,602

(22) Filed: Mar. 10, 2018

(51) Int. Cl.
*G10D 9/02* (2006.01)

(52) U.S. Cl.
CPC ..... *G10D 9/026* (2013.01)

(58) Field of Classification Search
CPC ..... G10D 9/026
See application file for complete search history.

(56) References Cited

U.S. PATENT DOCUMENTS

| | | | | |
|---|---|---|---|---|
| 3,807,271 | A * | 4/1974 | Nipken | G10D 9/026 84/399 |
| 7,560,631 | B1 | 7/2009 | John et al. | |
| 8,036,493 | B1 | 10/2011 | Neustel | |
| 2014/0109748 | A1* | 4/2014 | Griffin | G10D 9/026 84/398 |

OTHER PUBLICATIONS http://iml.jou.ufl.edu/projects/spring03/aguilar/Brass.htm "Timeless Tunes" article on internet.
http://stomvi-usa.com/rim-size-reality-a-common-sense-approach/ "Stomi USA" article on internet.
http://storkcustom.com/mouthpieces/trumpet-mouthpieces/ "Stork Custom the Vacchiano Series" article on internet.
http://www.dwerden.com/Mouthpieces/trombone.cfm "Dwerden Trombone Mouthpieces" article on intenet.
http://www.dwerden.com/Mouthpieces/trombone-euphonium.cfm "Dwerden Trombone-Euphonium mouthpieces" article on internet.
http://www.mouthpieceexpress.com/catalog/jim-fox-mouthpiece-charts.html "Jim Fox's Ultimate Mouthpiece Comparison Chart" article on intenet.
http://www.thetrumpetblog.com/the-definitive-guide-to-trumpet-mouthpieces/ "Definitive Guide to Trumpet Mouthpieces" article on internet.
http://www.trumpetpro.com/images/gr_page.htm "The Trumpet Pro" article on internet.
https://www.gwmouthpieces.com/pages/mouthpiece-size-chart "Giddings Mouthpiece Size Chart" article on internet.
https://www.breslmairbrass.com/trumpet/rim-trumpet/ "Breslmair Airbrass" article on internet.
https://hub.yamaha.com/guide-to-brass-mouthpieces-part-2-cups-and-rims/ "Yamaha Guide to Brass Mouthpieces" article on internet.

(Continued)

*Primary Examiner* — Kimberly Lockett
(74) *Attorney, Agent, or Firm* — Karen Tang-Wai Sutton

(57) ABSTRACT

An improved rim for a mouthpiece for a plurality of non-French horn labrosone brass musical instruments. The improved rim has a rim width having a predetermined width measurement as a smallest width dimension taken of an outer edge, a crown, and an inner edge of the improved rim, where the rim width can be a same width as a playing surface of the improved rim, where the playing surface is a width of the improved rim engaged by a musician's lips. Also provided are improved rims removably or permanently affixed to the mouthpiece.

20 Claims, 9 Drawing Sheets

(56) References Cited

OTHER PUBLICATIONS http://www.grmouthpieces.com/rim.html "GR mouthpieces" article on internet.
https://www.researchgate.net/figure/259969572_Schematic-of-trumpet-mouthpiece-truncated-and-smoothly-joined-on-to-the-end-of-the-source "Schematic of trumpet mouthpiece—diagram only" internet source.
http://www.wilktone.com/?p=211 "Brief History of Brass Instruments" article on internet.
http://www.bestbrass.com/mouthpiece/pdf/for_you.pdf "Part Names of a Mouthpiece" article on internet.
https://static1.squarespace.com/static/57f2fbcae4fcb55918ffb38c/t/58e6ded117bffc41aadfad57/1491525367957/Mouthpiece+Guide+P.1 "Mouthpiece Parts and How the Parts Affect Performance" article on internet.
https://simple.wikipedia.org/wiki/mouthpiece_(brass) "Mouthpiece (Brass)" article on internet.
Measuring the Effect of the Reflection of Sound—research conference paper Apr. 2012 article on internet.
https://en.m.wikipedia.org/wiki/Brass_instrument "Brass Instruments" article on internet.
http://www.dwerden.com/Mouthpieces/tuba.cfm "Dwerden Mouthpiece Tuba" article on internet.
https://trombone.org/aticles/library/mouthpiecemed2-gloss.asp "Online Trombone Journal" article on internet.
http://www.wedgemouthpiece.com/about-the-wedge/ Website for an oval shaped mouthpiece.

* cited by examiner

MOUTHPIECE RIM FOR NON-FRENCH HORN LABROSONE MUSICAL BRASS INSTRUMENTS

CROSS REFERENCE TO RELATED APPLICATIONS

NA

STATEMENT REGARDING FEDERALLY SPONSORED RESEARCH OR DEVELOPMENT

NA

NAMES OF THE PARTIES TO A JOINT RESEARCH AGREEMENT

NA

INCORPORATION BY REFERENCE OF MATERIAL SUBMITTED ON A COMPACT DISC OR AS A TEXT FILE VIA THE EFS WEB SYSTEM

NA

STATEMENT REGARDING PRIOR DISCLOSURES BY THE INVENTOR OR A JOINT INVENTOR

NA

BACKGROUND OF THE INVENTION

Field of the Invention

The present invention pertains to the field of mouthpieces for non-French horn labrosone brass musical instruments, specifically an improved mouthpiece rim for brass instruments such as tubas, trumpets, euphoniums, and trombones.

Background Art

A musical brass instrument produces sound by the sympathetic vibration of air. A sympathetic vibration is a harmonic phenomenon wherein a formerly passive vibratory body responds to external vibrations to which it has a harmonic likeness, and in the case of a brass instrument such as a trumpet, sound is produced by sympathetic vibration of air in a tubular resonator, for instance, a trumpet mouthpiece, in sympathy with the vibration of the player's lips. Brass instruments are thus also referred to as labrosones, literally meaning "lip-vibrated instruments".

The player's ability to control the sound produced by the instrument thus is critically dependent on the player's embouchure control, specifically, the agility and flexibility of the player's lips engaging the mouthpiece of the instrument, which depends at least partially on the physical characteristics of the mouthpiece rim with which the player's lips engage.

Historically, the French horn was the first musical instrument in the brass family of instruments to be used consistently by composers in the early 1700s in orchestras, and its mouthpiece was apparently copied and repeated for all succeeding orchestral brass family instrument mouthpieces by expanding its relative size based on the different sized instruments. This resulted in a homogenous look for brass instrument family mouthpieces, but unfortunately, a resized French horn mouthpiece for a tuba, for instance, results in a mouthpiece with a fat and unwieldy rim that causes the tubaist to lose essential agility and flexibility. Non-French horn playing musicians, such as tubaists and trombonists, all suffer from the shape and size of the mouthpiece rims for those instruments: the French horn mouthpiece shape is truly only suitable for the French horn mouthpiece itself. The configuration of mouthpiece rims for brass instruments other than for French horns thus are apparently more a function and result of history and visual appeal rather than actual performance enhancement value to the players of those instruments.

What is needed is an improved mouthpiece rim for non-French horn labrosone brass instruments whose shape and size maximizes playing agility, and flexibility, and reduces to the lowest possible degree the lips dragging, sticking, or catching on the rim. Additionally, the improved rim provides a more suitable container for the player's lips, as opposed to mashing them down or unduly pressing on them.

DISCLOSURE OF INVENTION

The invention is an improved rim for all non-French horn labrosone brass instrument mouthpieces having a cup with an uppermost circumference to which the improved rim is affixed, the improved rim having an inner edge and an opposed outer edge, and a crown with a predetermined shape formed between the inner edge and the outer edge joining the inner edge with the outer edge and having an uppermost height measurement taken from the inner edge and the outer edge. The improved rim has a rim width measured as a smallest predetermined width measurement of at least one of the inner edge, the crown, and the outer edge, and is a same width as a playing surface of the improved rim. The playing surface is a surface against which a plurality of lips of a musician engages the improved rim so as to create a seal between the plurality of lips and the improved rim.

The rim width according to the invention ranges between about 0.1 mm at its smallest relative side to no more than about 6.85 mm for a mouthpiece for a tuba and a sousaphone, no more than about 6.05 mm for a mouthpiece for a bass trombone, no more than about 5.95 mm for a mouthpiece for at least one of a euphonium, a baritone horn, a tenor trombone, an alto trombone, a soprano trombone, and a sackbut, and no more than about 4.30 mm for a mouthpiece for at least one of a trumpet, cornet and a flugelhorn.

The improved rim is also provided as a removable or permanently affixed rim for the mouthpiece.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 1A:
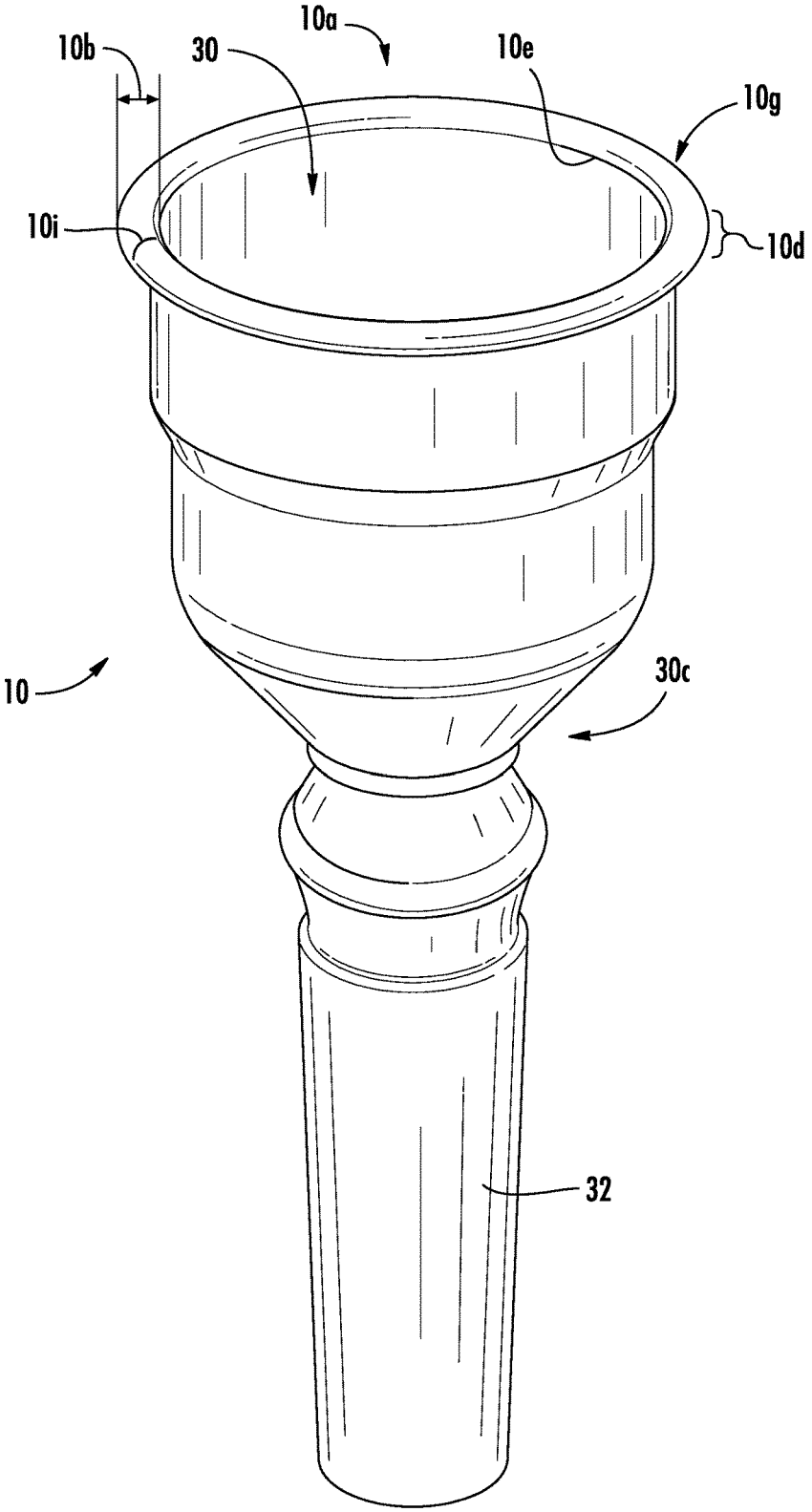
FIG. 1A is a perspective view of a first embodiment of an improved mouthpiece having an improved rim according to the invention, represented here as a tuba mouthpiece, shown with a skeletonized design.

The following is a list of reference labels used in the drawings to label components of different embodiments of the invention, and the names of the indicated components.

10 improved mouthpiece
10*a* improved rim
10*b* rim width
10*c* cup diameter
10*d* rim contour or contour
10*e* inner edge
10*f* rim threads (detachable rim only)
10*g* outer edge
10*h* bite
10*i* crown
20 prior art mouthpiece
20*a* prior art rim
20*b* prior art rim width
20*c* prior art cup diameter (measured from inner edge to inner edge)
20*d* prior art rim contour or prior contour
20*e* prior art rim inner edge
20*f* prior art rim outer edge 20*h* prior art bite
20*i* prior art crown
30 cup
30*a* cup rim end
30*b* cup threads (on cup for detachable rim embodiment only)
30*c* cup shank end or shank end
30*d* hole
30*e* rim mating end
32 shank
34 throat
36 backbore
40 vertex
42 co-vertex
44 hills
46 valleys

DEFINITIONS

The inventors note that while the brass mouthpiece industry uses common terms such as bite or crown, there are no standard definitions for these terms. For utmost clarity, the following terms used in this disclosure and their definitions are as follows:

Rim: an uppermost portion of a mouthpiece generally against which a player's lips generally contacts when a brass instrument is played, having an innermost rim edge or inner edge, a crown, and an outermost rim edge or outer edge.

Bite: a shape of the inner edge

Contour: a shape of the outer edge

Crown: a highest point of the rim measured relative to the inner edge and the outer edge Skeletonized mouthpiece: a mouthpiece which has had some external actual or intended mouthpiece material removed to improve projection and response Cup diameter: a diameter measured from one inner edge to an opposed inner edge.

Rim width: a measurement of the rim taken from the outer edge to the inner edge.

DETAILED DESCRIPTION

Figure 1B:
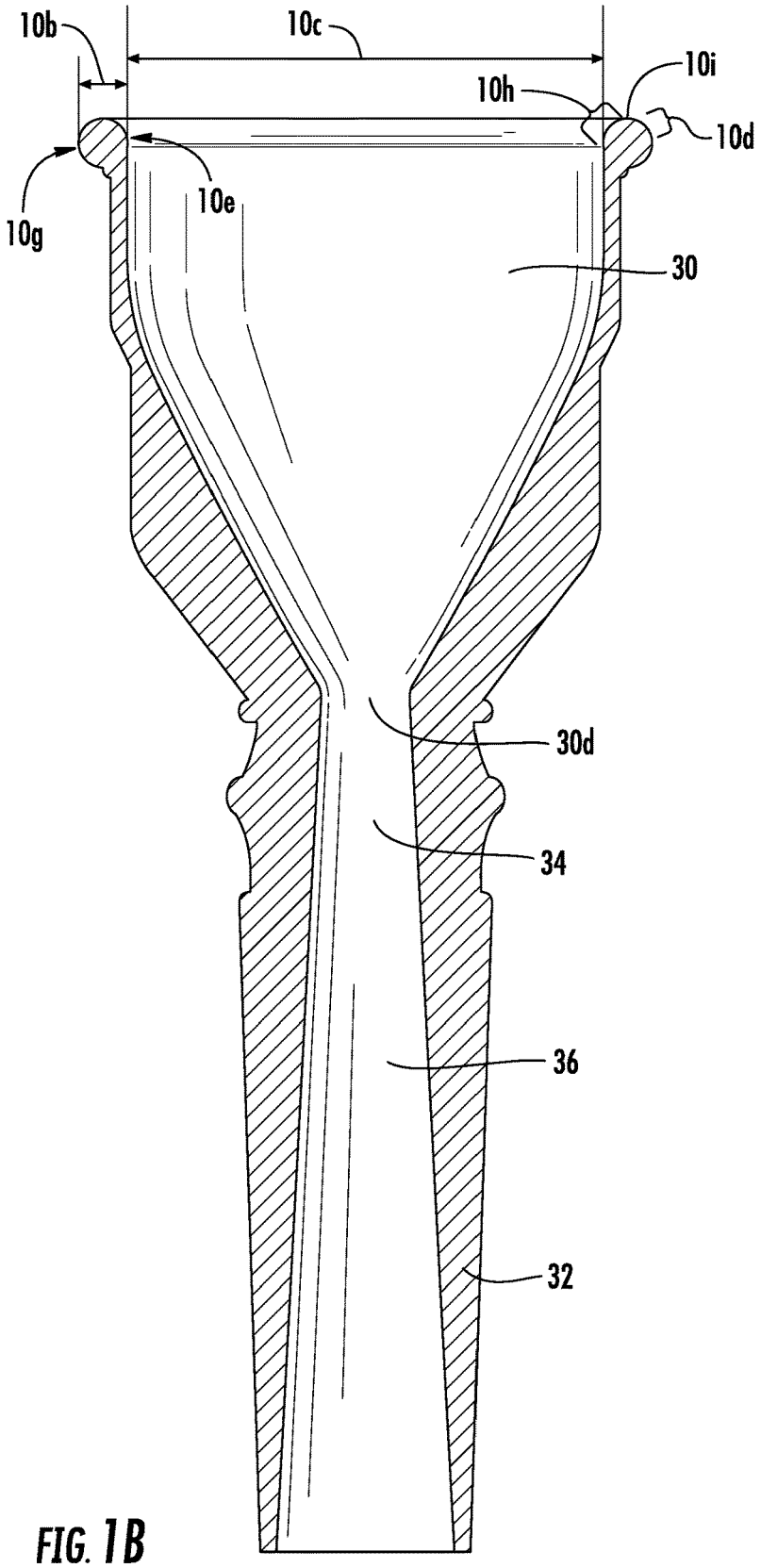
FIG. 1B is a side elevation, cross sectional view of the improved mouthpiece in FIG. 1A.
Figure 1C:
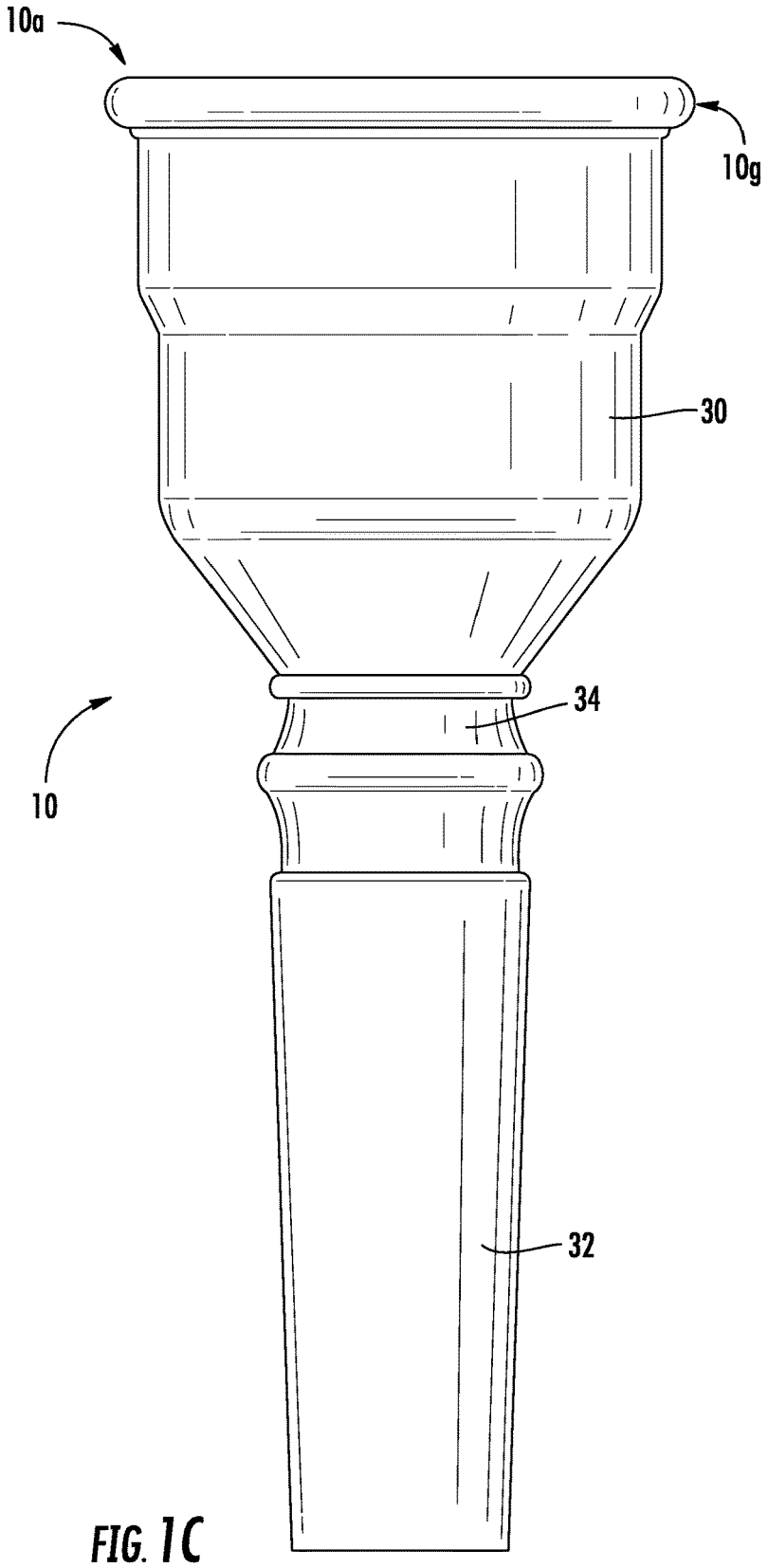
FIG. 1C is a side elevation view of the improved mouthpiece in FIG. 1A.
Figure 2A:
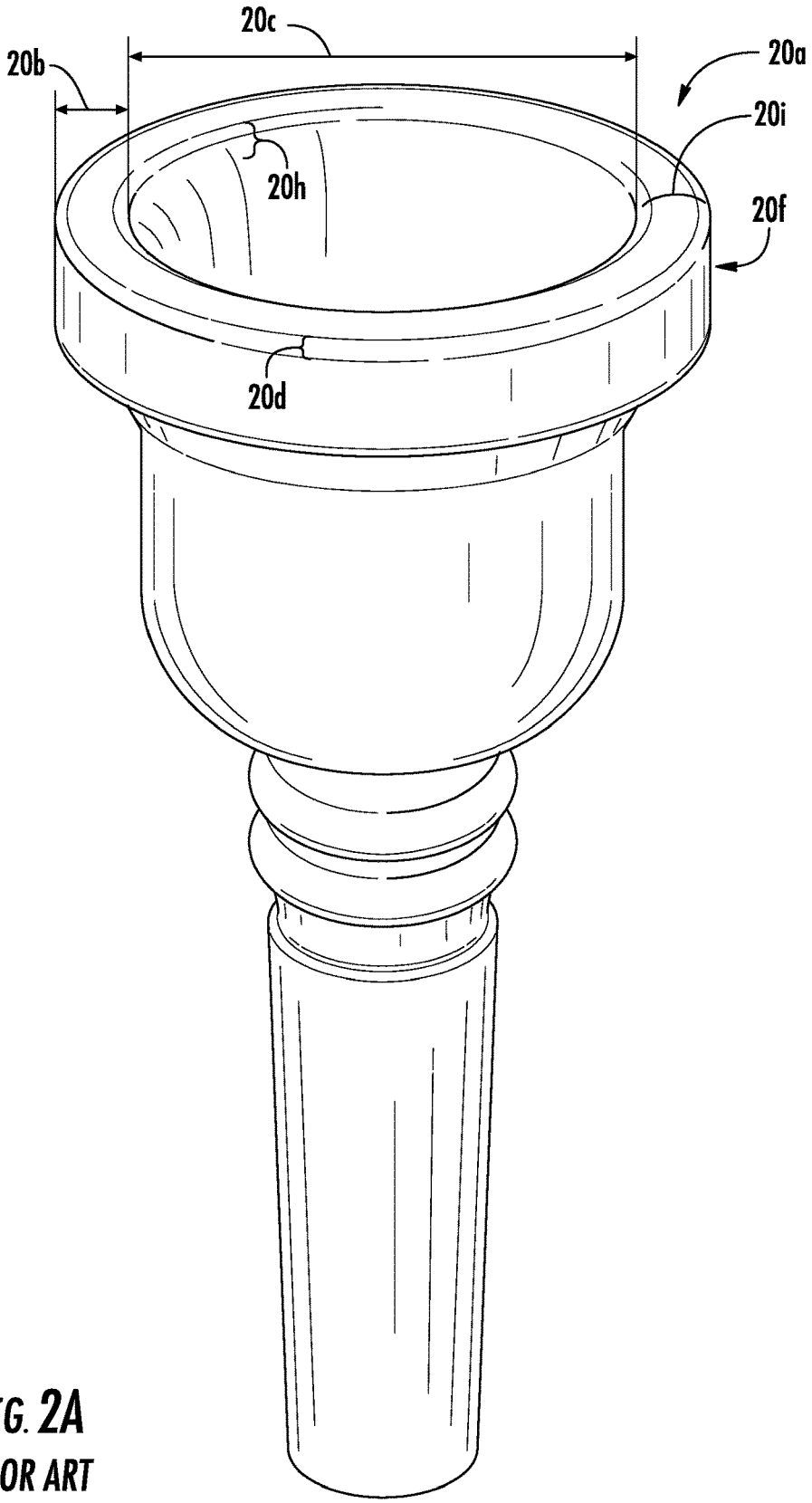
FIG. 2A PRIOR ART
FIG. 2A is a prior art non-skeletonized mouthpiece for a tuba, shown with a standard rim width of 8.60 mm.
Figure 2B:
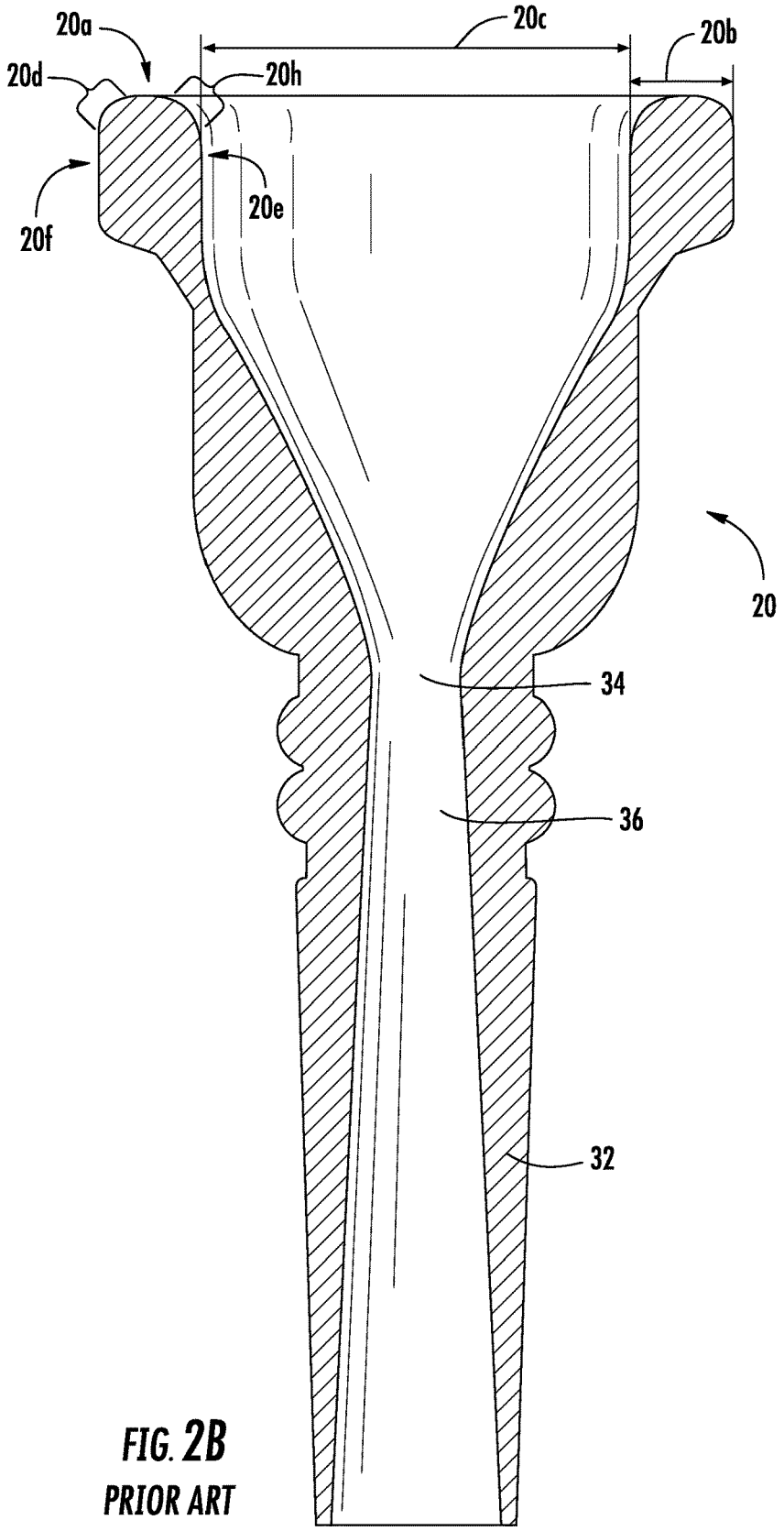
FIG. 2B PRIOR ART
FIG. 2B is a side elevation, cross sectional view of the prior art mouthpiece shown in FIG. 2A, presented for comparison with the improved mouthpiece in FIG. 1B.
Figure 2C:
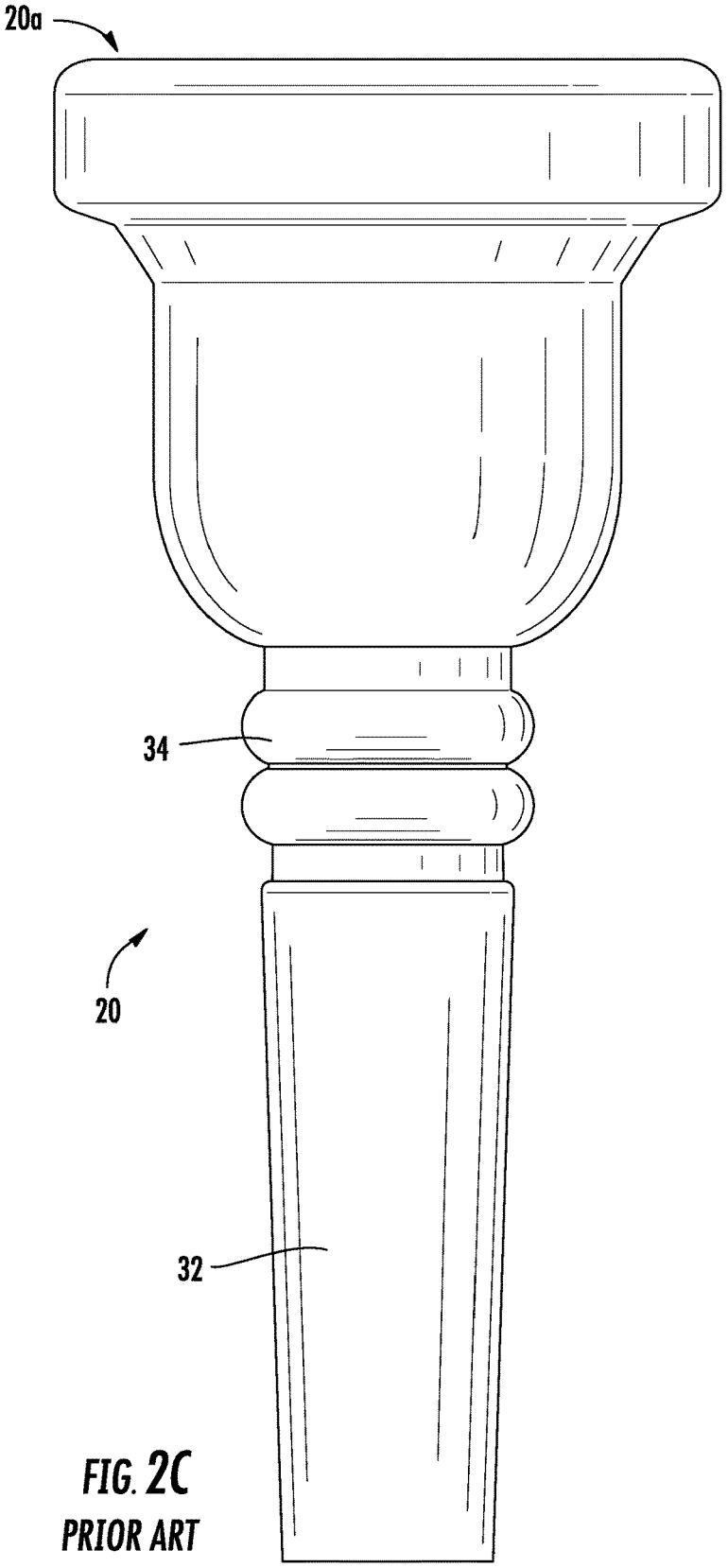
FIG. 2C PRIOR ART
FIG. 2C is a side elevation view of the prior art mouthpiece in FIG. 2A.

An improved mouthpiece for non-French horn labrosone brass instruments according to the invention 10 and an improved mouthpiece rim 10*a* according to the invention are shown in FIGS. 1A-C, represented as a skeletonized tuba mouthpiece with a rim, the rim having a crown 10*i* with a largely flattened profile, and for comparison purposes, a prior art non-skeletonized tuba mouthpiece and rim are shown in FIGS. 2A-C and marked "Prior Art" on the Figures. The inventors note that whether a mouthpiece is skeletonized or non-skeletonized is irrelevant to the invention described herein, whose focus is an improved rim.

Turning to the Figures, the improved mouthpiece 10 has a cup 30 upon which the improved rim 10*a* is formed and/or affixed to a rim end 30*a* and has a hole 30*d* formed at a shank end 30*c* that leads to a tubular shank 32 with a narrowed throat 34 leading to a relatively wider backbore 36. The improved mouthpiece 10 is thus generally conical ("V" shaped) or semi circular ("U" shaped) in shape, wider at the rim end 30*a*, with a relatively narrow throat 34 at a bottom of the cup 30 as compared to the diameter of the cup measured at a rim location, and then widening again at the backbore 36. The inventors note that his invention does not primarily change the general shape of the cup, shank, throat, and backbore of the mouthpiece; rather, the focus of his invention is specifically on an improved rim 10*a*.

The improved rim 10*a* is comprised of a rim width 10*b* measured typically from an inner edge 10*e* to an opposed outer edge 10*g*, the improved rim further comprised of a cup diameter 10*c*, a crown 10*i*, a bite 10*h*, and the contour 10*d*, taken together defining a shape, a size and a profile of the improved rim 10*a*. As previously noted, the crown 10*i* of the representative tuba mouthpiece shown in FIGS. 1A-C is relatively flat.

The bite 10*h* is a shape of the inner edge 10*e*, the bite extending from a lowermost portion of the inner edge of the improved rim 10*a*, but excluding any inner wall of the cup 30 and can range from sharply defined, where an uppermost position of the inner edge meets the crown 10*i* at an approximately 90 degree angle, or rounded, where the bite 10*h* slopes upwardly and outwardly from an interior of the cup 30 to meet the crown 10*i* so as to resemble a portion of a parabolic curve rising to its vertex. The bite 10*h* can be a smooth, regular extension of the overall shape of the cup 30, or designed to increase at a smaller rate such that a cup diameter is proportionally wider than would be expected if the bite slope was simply an extension of the established upwards shape of inner wall of the cup.

Figure 4:
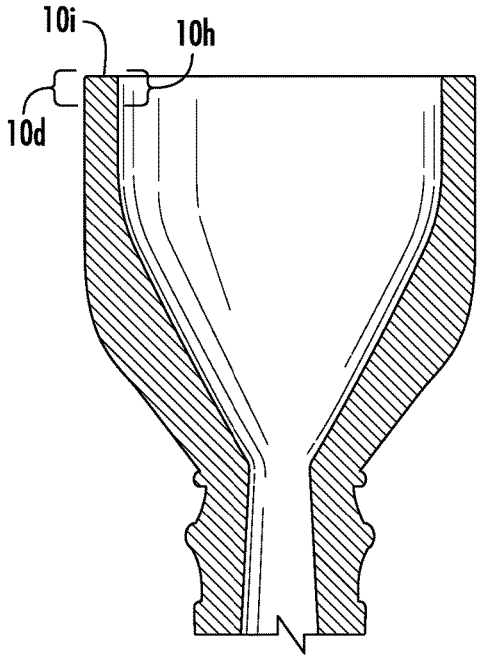
FIG. 4 is a side elevation, cross sectional view of the second embodiment of the improved mouthpiece according to the invention, shown with a rim having a flattened, or non-domed shaped crown with a bite on a same horizontal plane as a contour and where a playable surface is evenly distributed across the entire surface.
Figure 5:
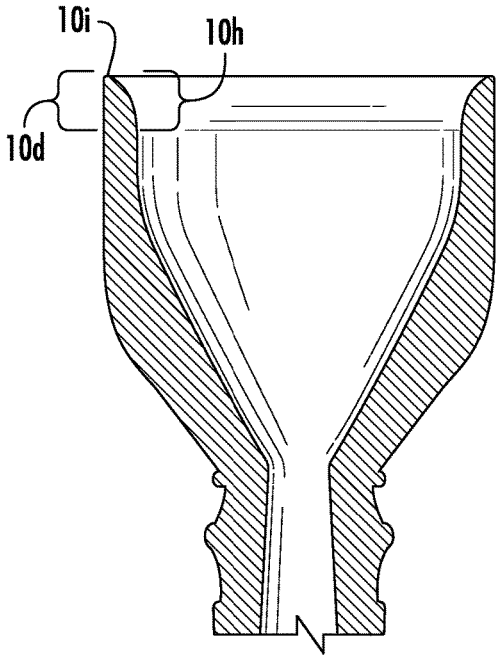
FIG. 5 is a side elevation, cross sectional view of a third embodiment of the improved mouthpiece according to the invention, shown with a rounded, or domed shape crown, with the inner edge on a different and lower horizontal plane relative to the crown and relative to the outer edge, and where the playable surface area is along the crown 10*i* towards the outer edge.
Figure 6:
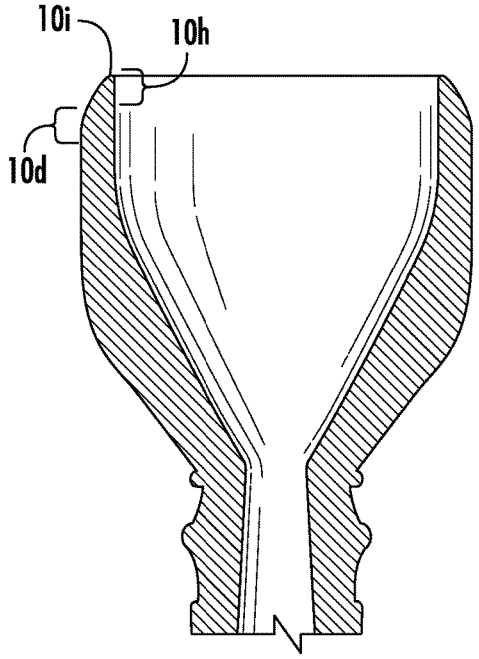
FIG. 6 is a side elevation, cross sectional view of a fourth embodiment of the improved mouthpiece according to the invention, shown where the crown is rounded, or domed shape crown and on a same plane as the inner edge, but where the contour is on a lower plane compared to that of the inner edge, where the playable surface area is along the crown and the bite where the player's lips do not touch the outer edge along the outermost portion of the improved rim.

The rim 10*a* has a crown 10*i*, a highest point relative to the inner edge 10*e* and outer edge 10*g*. Like the bite 10*h*, a shape of the crown 10*i* can be rounded, flat or mostly flattened, as shown in FIG. 4, or less typically, be a vertex or peak or point, as shown in FIGS. 5-6. Preferred crown shapes are typically based on a plurality of characteristics including a physical size and shape of a musician's lips which can affect playing ability as well as playing comfort.

One of the inventors is a tubaist with over 35 years of world class professional playing experience who notes that in his experimentation and development of the improved mouthpiece 10 and specifically the improved rim 10*a*, seemingly small or subtle changes in the prior art mouthpieces 20 can nevertheless result in significant changes in playability, and his desire to improve his musical and technical abilities as a tubaist specifically, but also as a brass player generally, led to the development of a new range of performance-based rim widths 10*b* for the various non-French horn family of brass instruments.

The improved rim widths 10*b* according to the invention are as follows for each instrument:

Tuba and sousaphone: ≤0.1 mm to about 6.85 mm

Bass trombone: ≤0.1 mm to about 6.05 mm

Euphonium and baritone horn: ≤0.1 to about 5.95 mm

Tenor, alto, and soprano trombones, sackbuts: ≤0.1 mm to about 5.95 mm

Trumpet family of instruments (including cornets and flugalhorns): ≤0.1 to about 4.30 mm For comparison purposes, the following are standard width ranges for rims found in the prior art:

Prior art tuba and sousaphone: 6.89-10+ mm

Prior art bass trombone: 6.10-8+ mm

Prior art euphonium, baritone horn: 6-8+ mm

Prior art tenor, alto, and soprano trombones, sackbuts: 6-8+ mm

Prior art trumpet family of instruments (including cornets and flugalhorns): 4.32-5.092+ mm It should be noted that in the prior art, it is common practice for a listed "rim" size to be measured across the widest inside diameter of the mouthpiece. This measurement is more accurately called the "inside diameter" or the "cup diameter", and the inventors stress that they are not using this common measuring method for the "rim" size; references to "rim width" truly measures only the rim itself, and here "cup diameter" refers to the diameter measured across a top of the cup.

The improved rim 10*a* may be composed of any of many different materials or combinations thereof that can readily be formed into shaped objects provided that the components selected are consistent with the intended operation of the invention, in this case a mouthpiece formed into a cup with a shank, and a through hole leading from a bottom of the cup and through the shank. Suitable materials include composites such as carbon-fiber and/or other like materials, polymers such as plastic, nylon, metals, alloys, wood and/or other like materials that are commonly or uncommonly used for the prior art mouthpieces 20, and includes any additional metal plating on the improved rim 10*a* that is commonly used to cover prior art mouthpieces and rims. It should be noted that the materials used must be durable, and of sufficient strength and stiffness to withstand significant, persistent pressure from both a musician's lips as well as from the air being forced into the cup and through the shank.

Figure 3:
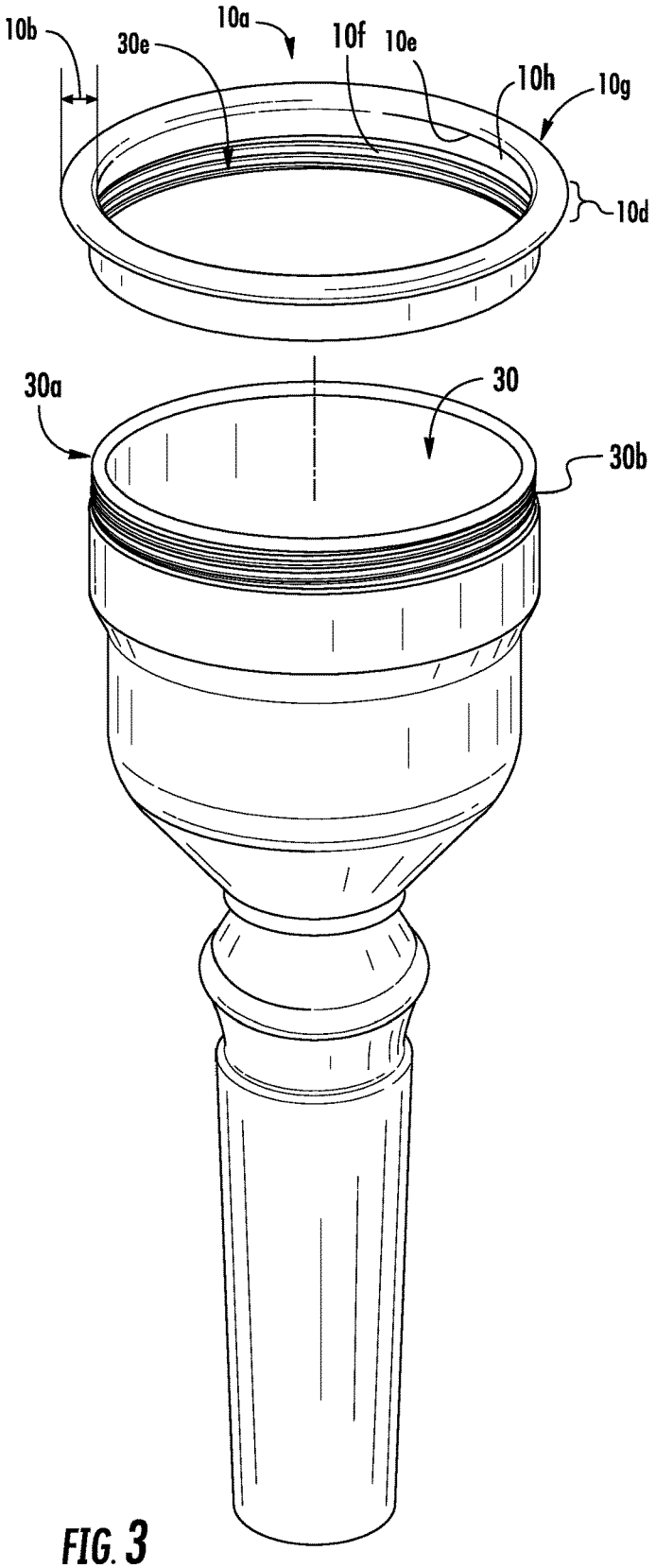
FIG. 3 is an exploded perspective view of an improved mouthpiece for a tuba, configured with a detachable rim, here shown as a rim with interior threads that screw onto mating threads on an uppermost portion of a cup of the mouthpiece.

As shown in FIG. 3, the improved mouthpiece 10 and improved rim 10*a* also includes any array of mouthpieces with separate parts to include an improved rim 10*a* that is detachable, allowing the musician to quickly and easily change the rim 10*a* as desired, and affords the musician a less costly way to alter the mouthpiece without needing to purchase an entirely new mouthpiece. The detachable rim 10*a* is further formed with rim threads 10*f* along a rim mating end 30*e* with a plurality of corresponding complementary threads 30*b* formed along an uppermost end or cup rim end 30*a*. Currently, in the prior art, detachable rims are available in standard prior art sizes, and it is impossible to affix a detachable rim for a trumpet, for instance, onto a mouthpiece for a tuba, due to the size of the mating threads and the cup, as there is a preconceived prior art expectation that the rim for the tuba will be larger than the rim for the trumpet.

The inventors stress that although the rim width 10*b* is generally measured from the inner edge 10*e* to the outer edge 10*g*, given that there are many possible variations on the contours 10*d*, bites 10*h*, and crowns 10*i* that can for practical purposes effectively change a playable width of the rim width 10*b*, the term "rim width" used here as it pertains to the improved mouthpiece 10 and improved rim 10*a* also includes any rim width that falls within the range of widths described in this disclosure, regardless of the contour 10*d* and bite 10*h* or edge shapes of the rim itself. Hence, "rim width" used in this disclosure is not limited to the outermost measurements of the improved rim 10*a* itself, but includes a width of a playing surface of the rim, meaning a surface area against which the player's lips press and engage. When the rim width 10*b* as measured from the cup diameter to the outermost edge of the rim, and the playing surface of the rim due to contour and edge design differ, the rim width 10*b* includes the smallest width dimension. As the contour 10*d* and the bite 10*h* can be adjusted, the inventor can foresee circumstances where the playing surface of the improved rim 10*a* may actually be smaller than the overall rim width 10*b* as measured in a traditional manner from the outer edge 10*g* to the inner edge 10*e* of the rim. Hence, the following, non-exhaustive examples of possible contour and edge shapes are included as part of the invention described herein:

The rim 10*a* having a flattened, or non-domed shape crown 10*i*, with the bite 10*h* on a same horizontal plane as the contour 10*d* and where the playable surface is evenly distributed across the entire surface (FIG. 4)

The rim 10*a* having a rounded, or domed shape crown 10*i*, with the inner edge 10*e* on a different and lower horizontal plane relative to the crown 10*i* and relative to the outer edge 10*g*, and where the playable surface area is along the crown 10*i* towards the outer edge 10*g* (FIG. 5); and The rim 10*a* having a rounded, or domed shape crown 10*i*, whose crown 10*i* is on a same plane as the inner edge 10*e*, but where the contour 10*d* is on a lower plane compared to that of the inner edge 10*e*, where the playable surface area is along the crown 10*i* and the bite 10*h*, where the player's lips do not touch the outer edge 10*g* along the outermost portion of the improved rim 10*a* (FIG. 6).

These are just a few examples of rim configuration that are contemplated by the improved mouthpiece 10 and improved rim 10*a* described herein, and these examples are provided as guidance to show that the playable surface of the rim width is a critical improvement over the prior art mouthpiece rim. FIGS. 1A-C show the representative tuba rim as having a generally flattened crown 10*i* with a curved bite 10*h* and rounded contour 10*d*, but this is just one example of a suitable rim shape of the invention. Changes in contour and bite are thus also contemplated by this disclosure so long as the playable surface of the rim falls into the ranges described herein.

Figure 7A:
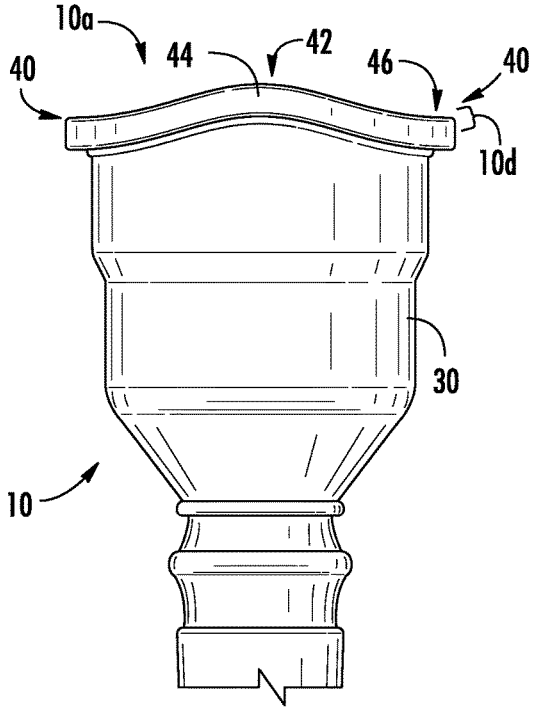
FIGS. 7A-B are perspective views of a fifth embodiment of the improved mouthpiece according to the invention, shown having parallel, spaced apart hills located at the vertexes or at the co-vertexes of the rim.
Figure 7B:
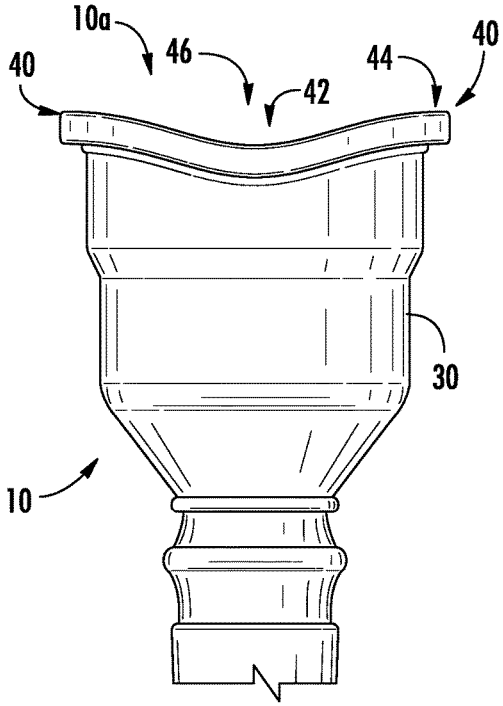
Figure 7C:
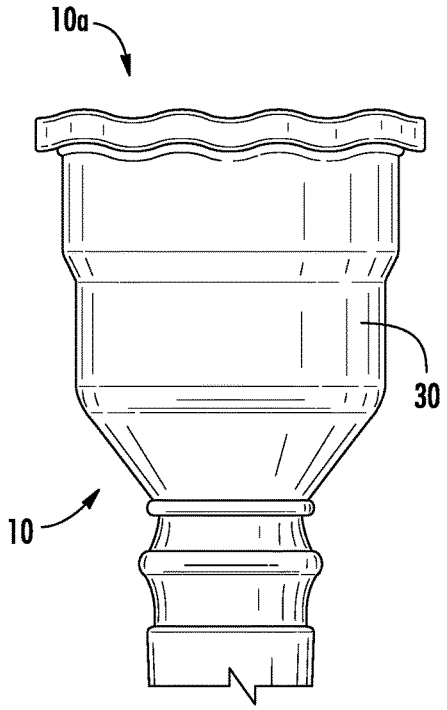
FIGS. 7C-D are perspective views of two representative textures for the improved rims.
Figure 7D:
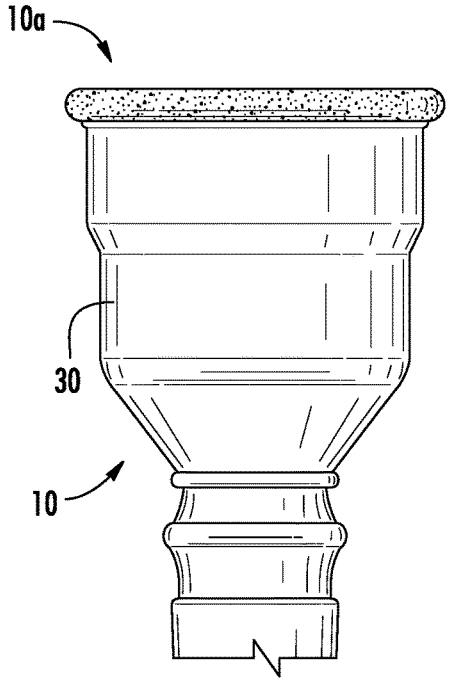

FIGS. 7A-D show yet another embodiment of the improved rim 10*a* according to the invention. FIGS. 7A and 7B show an approximately oval or elliptical shaped rim and mouthpiece, as opposed to the circular mouthpieces shown in FIGS. 1-6 and whose circular shape is a prior art mouthpiece and rim shape. The inventors use the term "oval" here to include oval, elliptical, and other shapes that roughly resemble ovals and ellipses. Each oval has a pair of opposed vertexes 40 and a pair of opposed co-vertexes 42, and oriented so that the vertexes 40 are positioned at a pair of corners of the plurality of lips of the musician, where an upper lip and a lower lip of the plurality of lips meet. The co-vertexes 42 are thus positioned along a center of the plurality of the lips of the musician. In FIG. 7A, the improved rim 10*a* rises into a pair of opposed hills 44 at the co-vertexes 42, with a pair of valleys 46 located at the vertexes 40 at the pair of corners. In FIG. 7B, the pair of hills 44 are positioned at the vertexes 40, and the pair of valleys 46 at the co-vertexes 42. FIGS. 7C-D show two different improved texturized patterns that the inventors feel are useful improvements over the prior art smooth playing surface: In FIG. 7C, the improved rim 10*a* is undulating, or rippled, and in FIG. 7D, the improved rim 10*a* is formed with a textured surface, such as a dimpled texture shown, or alternatively any other textured surface formed with grooves such as parallel lines, cross hatched grooved, scored, etc. (not shown). It should be noted that the textured surface could also be just on portions of the rim and not over the entire rim surface to also help with positioning of the lips onto the rim. The idea behind the texture is to provide the musician a sensory cue. Different textures can also be incorporated as a way to personalize rims, or as a visual or lip sensory way to differentiate between different rims, which may be desired as certain rims may be more suitable for playing one musical composition but perhaps not for a different musical composition. The sensory aspect of the rims also allows musicians who are visually impaired to nevertheless understand which mouthpiece is being used. The inventors note that the textures and oval shapes of the improved rims shown in FIGS. 7A-D can also include all the improved features shown in FIGS. 1A-C. While FIGS. 7A-B show oval shaped rims, the hill-valley shape can also be used on traditionally circular rims of the prior art.

The improved rim 10*a* gives musicians for all the brass family of instruments the same potential for flexibility and agility French hornists have long enjoyed and are famous for, making for instance the performance of the last movement of the Strauss 2nd Horn Concerto so dazzling. Contrast that potential to the tubaists' challenge for similar dazzle on the last movement of the Vaughan Williams Concerto for Bass Tuba, where an unimproved rim requires the tubaist to fight dragging, sticking, or catching of the players' lips on the unimproved prior art rim, as well as mashing the lips down or unduly pressing the lips against the unimproved rim.

Another wonderful benefit for tubaists in particular is not having the big fat unwieldy rim hit their noses as they go into the low pedal register, which is annoying as well as callous-producing and painful. Without this fat rim, tubaists can find a new potential for their low register embouchure that is much more effective than just continually extending the upper register embouchure down into the pedal register.

The present invention may be readily and easily adapted to any mouthpiece currently available on the market, and additionally used on any future mouthpieces.

The potential for improved flexibility and agility (and reducing to the lowest possible degree the lips dragging, sticking, or catching on the rim, along with mashing them down or unduly pressing on them) is valuable for all player skill levels, from beginner to top professionals, and therefore improves playing experience.

It is to be understood that the above-described arrangements are only illustrative of the application of the principles of the present invention. Numerous modifications and alternative arrangements may be devised by those skilled in the art without departing from the scope of the present invention.

Accordingly, any components of the present invention indicated in the drawings or herein are given as an example of possible components and not as a limitation.

What is claimed is:

1. An improved rim for a non-French horn labrosone brass instrument mouthpiece having a cup with an uppermost circumference to which the improved rim is affixed, the improved rim comprising:

an inner edge and an opposed outer edge;

a crown having a predetermined shape formed between the inner edge and the outer edge;

a rim width; and a playable surface of the improved rim;

wherein the crown is further comprised of an uppermost height measurement as measured as a vertical height relative to the inner edge and the outer edge;

wherein the playable surface is a surface having a predetermined shape against which a pair of lips of a musician engages the improved rim so as to create a seal between the pair of lips and the improved rim;

wherein the rim width is a smallest predetermined width measurement using at least one of the inner edge, the crown, and the outer edge as a measurement reference point; and wherein the rim width is no less than 0.1 mm wide and no larger than a smallest rim width for the non-French horn labrosone mouthpiece selected from tuba, sousaphone, bass trombone, euphonium, baritone horn, tenor trombone, alto trombone, soprano trombone, sackbut, trumpet, cornet, and flugelhorn mouthpieces.

2. The improved rim of claim 1, wherein the rim width for a mouthpiece for one of the tuba and the sousaphone is no more than 6.85 mm.

3. The improved rim of claim 1, wherein the rim width for a bass trombone mouthpiece is no more than about 6.05 mm.

4. The improved rim of claim 1, wherein the rim width for one of a euphonium, baritone horn, tenor trombone, alto trombone, soprano trombone and a sackbut mouthpiece is no more than about 5.95 mm.

5. The improved rim in claim 1, wherein the rim width for one of a trumpet, cornet and a flugelhorn mouthpiece is no more than about 4.30 mm.

6. The improved rim in claim 1, wherein the improved rim is removably affixed to the mouthpiece.

7. The improved rim in claim 6, further comprising:

a cup diameter defined by a circumference of the inner edge about an uppermost portion of the cup;

a rim mating end having an inner circumference; and an array of threads formed along the inner circumference of the rim mating end;

wherein the rim mating end is opposed to the playing surface of the rim; and wherein the cup is further formed with an array of threads mateable with the array of threads formed along the inner circumference of the rim mating end.

8. The improved rim of claim 1, wherein the improved rim is permanently affixed to the mouthpiece and wherein the mouthpiece and rim are a single piece.

9. The improved rim of claim 1, wherein the playable surface is formed with a texturized pattern.

10. The improved rim of claim 1, wherein the playable surface is formed with an undulating pattern of a plurality of same height crowns separated by same depth valleys.

11. The improved rim of claim 1, further comprising:

a pair of spaced apart hills formed on the playable surface; and a pair of opposed vertexes and a pair of opposed co-vertexes formed on the playable surface; and wherein the pair of lips of the musician is further comprised of an upper lip meeting a lower lip at opposed mouth corners and a center location on each of the upper lip and the lower lip;

wherein the predetermined shape of the playable surface is one of an oval shape and an ellipse shape, the oval shape and the ellipse shape each having a pair of opposed vertexes and a pair of opposed co-vertexes and oriented such that the pair of opposed vertexes are positioned at the opposed mouth corners.

12. The improved rim of claim 1 wherein the pair of spaced apart hills are located on one of the pair of opposed vertexes oriented so as to be positioned at the pair of corners of the pair of lips of the musician, and on the pair of opposed co-vertexes at about the center of the pair of lips of the musician.

13. An improved rim for a non-French horn labrosone brass instrument mouthpiece having a cup with an uppermost circumference to which the improved rim is affixed, the improved rim comprising:

an inner edge and an opposed outer edge;

a playable surface having a predetermined shape formed between the inner edge and the outer edge;

a pair of spaced apart hills formed on the playable surface;

a pair of opposed vertexes and a pair of opposed co-vertexes formed on the playable surface; and a rim width;

wherein the playable surface is a surface against which a pair of lips of a musician having an upper lip meeting a lower lip at opposed mouth corners and a center location on each of the upper lip and the lower lip, engages the improved rim so as to create a seal between the pair of lips and the improved rim;

wherein the rim width is a same width as the playable surface; and wherein the predetermined shape of the playable surface is one of an oval and an ellipse shape, the oval and the ellipse shape having a pair of opposed vertexes and a pair of opposed co-vertexes and oriented such that the pair of opposed vertexes are positioned at the opposed mouth corners.

14. The improved rim of claim 13 wherein the pair of spaced apart hills are located on one of the pair of opposed vertexes oriented so as to be positioned at the pair of corners of the pair of lips of the musician, and on the pair of opposed co-vertexes at about the center of the pair of lips of the musician.

15. The improved rim of claim 13, wherein the playable surface further comprises a texturized pattern.

16. The improved rim of claim 13, wherein the playable surface further comprises an undulating surface.

17. The improved rim of claim 14, wherein the playable surface further comprises a texturized pattern.

18. The improved rim of claim 14, wherein the playable surface further comprises an undulating surface.

19. The improved rim of claim 13, further comprising threads about a circumference of the improved rim.

20. The improved rim of claim 14, further comprising threads about a circumference of the improved rim.

* * * * *